US006125169A

United States Patent [19]

Wandke et al.

[11] Patent Number: 6,125,169

[45] Date of Patent: Sep. 26, 2000

[54] TARGET INTEGRAL HEAT SHIELD FOR X-RAY TUBES

[75] Inventors: Norman E. Wandke, Naperville; Gerald J. Carlson, Lombard, both of Ill.; Lester D. Miller, Hudson, Ohio; Qing Lu, Aurora, Ill.

[73] Assignee: Picker International, Inc., Highland Heights, Ohio

[21] Appl. No.: 08/994,631

[22] Filed: Dec. 19, 1997

[51] Int. Cl.[7] ..... H01J 35/10

[52] U.S. Cl. ..... 378/143; 378/127; 378/128

[58] Field of Search ..... 378/119, 121, 378/127, 128, 132, 141, 142

[56] References Cited

U.S. PATENT DOCUMENTS 3,735,176 5/1973 Langer et al. ..... 378/125
4,188,559 2/1980 Carville et al. ..... 378/128
4,232,247 11/1980 Ochi et al. .
4,688,239 8/1987 Schaffner et al. ..... 378/141
5,222,116 6/1993 Eloff et al. ..... 378/143

*Primary Examiner*—David P. Porta
*Attorney, Agent, or Firm*—Timothy B. Gurin; John J. Fry; Eugene E. Clair

[57] ABSTRACT

An x-ray tube includes an envelope defining an evacuated chamber in which an anode assembly is rotatably mounted to a bearing assembly and interacts with a cathode assembly for production of x-rays. The x-ray tube further includes a heat shield disposed in the envelope. The heat shield serves to reduce heat radiating from the anode assembly which is transferred to the bearing assembly or otherwise serves to insulate the bearing assembly from such radiated heat. The heat shield is brazed or otherwise bonded to the anode assembly and is comprised of a material having a low emissivity so that a minimum amount of heat radiates through the heat shield.

36 Claims, 3 Drawing Sheets

TARGET INTEGRAL HEAT SHIELD FOR X-RAY TUBES

TECHNICAL FIELD

The present invention relates to x-ray tube technology. More specifically, the present invention relates to reducing the heating effects on x-ray tube bearings caused by heat dissipated from the anode during operation.

BACKGROUND OF THE INVENTION

Conventional diagnostic use of x-radiation includes the form of radiography, in which a still shadow image of the patient is produced on x-ray film, fluoroscopy, in which a visible real time shadow light image is produced by low intensity x-rays impinging on a fluorescent screen after passing through the patient, and computed tomography (CT) in which complete patient images are digitally constructed from x-rays produced by a high powered x-ray tube rotated about a patient's body.

Typically, an x-ray tube includes an evacuated envelope made of metal or glass which is supported within an x-ray tube housing. The x-ray tube housing provides electrical connections to the envelope and is filled with a fluid such as oil to aid in cooling components housed within the envelope. The envelope and the x-ray tube housing each include an x-ray transmissive window aligned with one another such that x-rays produced within the envelope may be directed to a patient or subject under examination. In order to produce x-rays, the envelope houses a cathode assembly and an anode assembly. The cathode assembly includes a cathode filament through which a heating current is passed. This current heats the filament sufficiently that a cloud of electrons is emitted, i.e. thermionic emission occurs. A high potential, on the order of 100–200 kV, is applied between the cathode assembly and the anode assembly. This potential causes the electrons to flow from the cathode assembly to the anode assembly through the evacuated region in the interior of the evacuated envelope. A cathode focusing cup housing the cathode filament focuses the electrons onto a small area or focal spot on a target of anode assembly. The electron beam impinges the target with sufficient energy that x-rays are generated. A portion of the x-rays generated pass through the x-ray transmissive windows of the envelope and x-ray tube housing to a beam limiting device, or collimator, attached to the x-ray tube housing. The beam limiting device regulates the size and shape of the x-ray beam directed toward a patient or subject under examination thereby allowing images to be constructed.

In order to distribute the thermal loading created during the production of x-rays a rotating anode assembly configuration has been adopted for many applications. In this configuration, the anode assembly is rotated about an axis such that the electron beam focused on a focal spot of the target impinges on a continuously rotating circular path about a peripheral edge of the target. Each portion along the circular path becomes heated to a very high temperature during the generation of x-rays and is cooled as it is rotated before returning to be struck again by the electron beam.

Typically, the anode assembly is mounted to a rotor which is rotated by an induction motor. The anode assembly and rotor are part of a rotating assembly which is supported by a bearing assembly. The bearing assembly provides for a smooth rotation of the anode assembly about its axis with minimal frictional resistance. Bearings disposed in the bearing assembly often consist of a ring of metal balls which surround and rotatably support the rotor to which the anode assembly is mounted. Each of the balls are typically lubricated by application of lead or silver to its outer surface thereby providing support to the rotating assembly with minimal frictional resistance.

Heat created by the anode assembly during the production of x-rays may be thermally radiated and transferred to the bearings rather than being absorbed by the oil or other cooling fluid in the x-ray tube housing. For instance, heat radiating from the anode assembly may become absorbed at an intermediate point along a path P1 (FIG. 1) leading between the anode assembly and the bearings and thus be transferred to the bearings. Unfortunately, such heat transfer to the bearings has been found to deleteriously effect the bearing performance. For instance, prolonged or excessive heating to the lubricant applied to each ball of a bearing can reduce the effectiveness of such lubricant. Further, prolonged and/or excessive heating may also deleteriously effect the life of the bearings and thus the life of the x-ray tube.

In order to reduce the amount of heat passed from the anode assembly to the bearings during operation, a heat shield is often mechanically secured to the rotor. The heat shield is typically threaded to the rotor or secured using screws or pinning. Although such a heat shield does provide protection to the bearings from the heating effects of the anode assembly, the mechanical mounting of the heat shield to the rotor presents some difficulties. For instance, cutting threads in the heat shield for securing to the rotor is often a tedious and difficult process. Further, loose particles or chips created by mechanically joining the heat shield to the rotor and/or shaken off during operation of the x-ray tube can deleteriously effect x-ray tube life and/or performance.

Therefore, what is needed is an apparatus for reducing the heating effects on x-ray tube bearings caused by heat dissipated from the anode assembly which overcomes the shortfalls discussed above and others.

SUMMARY OF THE INVENTION

In accordance with the present invention, an x-ray tube is provided. The x-ray tube includes an anode assembly defining a target for intercepting a beam of electrons such that collision between the electrons and the anode assembly generate x-rays from an anode focal spot. The anode assembly is rotatably supported by a bearing assembly. The x-ray tube also includes a cathode assembly having a filament which emits electrons when heated. An envelope encloses the anode assembly, cathode assembly, and bearing assembly in a vacuum. The tube envelope also includes a means for reducing heat radiating from a region of the anode assembly.

In accordance with another aspect of the present invention and x-ray tube is provided. The x-ray tube includes an envelope defining an evacuated chamber in which an anode assembly is rotatably mounted to a bearing assembly and interacts with a cathode assembly to produce x-rays. A shield is coupled to the anode assembly for insulating the bearing assembly from heat generated during production of x-rays.

In accordance with yet another aspect of the present invention, an x-ray tube is provided. The x-ray tube includes an envelope defining an evacuated chamber, an anode assembly rotatably mounted within the evacuated chamber by way of a bearing assembly and operatively coupled with a rotor to provide rotation thereof, and a cathode assembly for generating a beam of electrons which impinge upon the rotating anode assembly on a focal spot to generate a beam of x-rays. An improvement of the x-ray tube includes a means for reducing heat transference to the bearing assembly, said means comprising a low heat emissive material on an outer surface of the anode assembly.

In accordance with still another aspect of the present invention, a method of reducing heat transference from an anode assembly to a bearing assembly is provided. The anode assembly is rotatably mounted to the bearing assembly within an evacuated chamber defined by an x-ray tube envelope. The method includes the step of applying a low emissivity coating to a surface of the anode assembly.

One advantage of the present invention is that the amount of heat radiated from the anode assembly to the bearing assembly is reduced, thereby reducing the transference of heat to the bearings.

Another advantage of the present invention is that heat shields are brazed or otherwise bonded to the anode assembly thereby minimizing the amount of particle loosening or chipping which may otherwise occur at mechanical joints.

Yet another advantage of the present invention is that a low emissive coating used alone or in conjunction with one or more heat shields provides a simple and easy way of further reducing the amount of heat radiated to the bearing assembly.

To the accomplishment of the foregoing and related ends, the invention then, comprises the features hereinafter fully described and particularly pointed out in the claims. The following description and the annexed drawings set forth in detail certain illustrative embodiment of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE PREFERRED EMBODIMENTS

Figure 1:
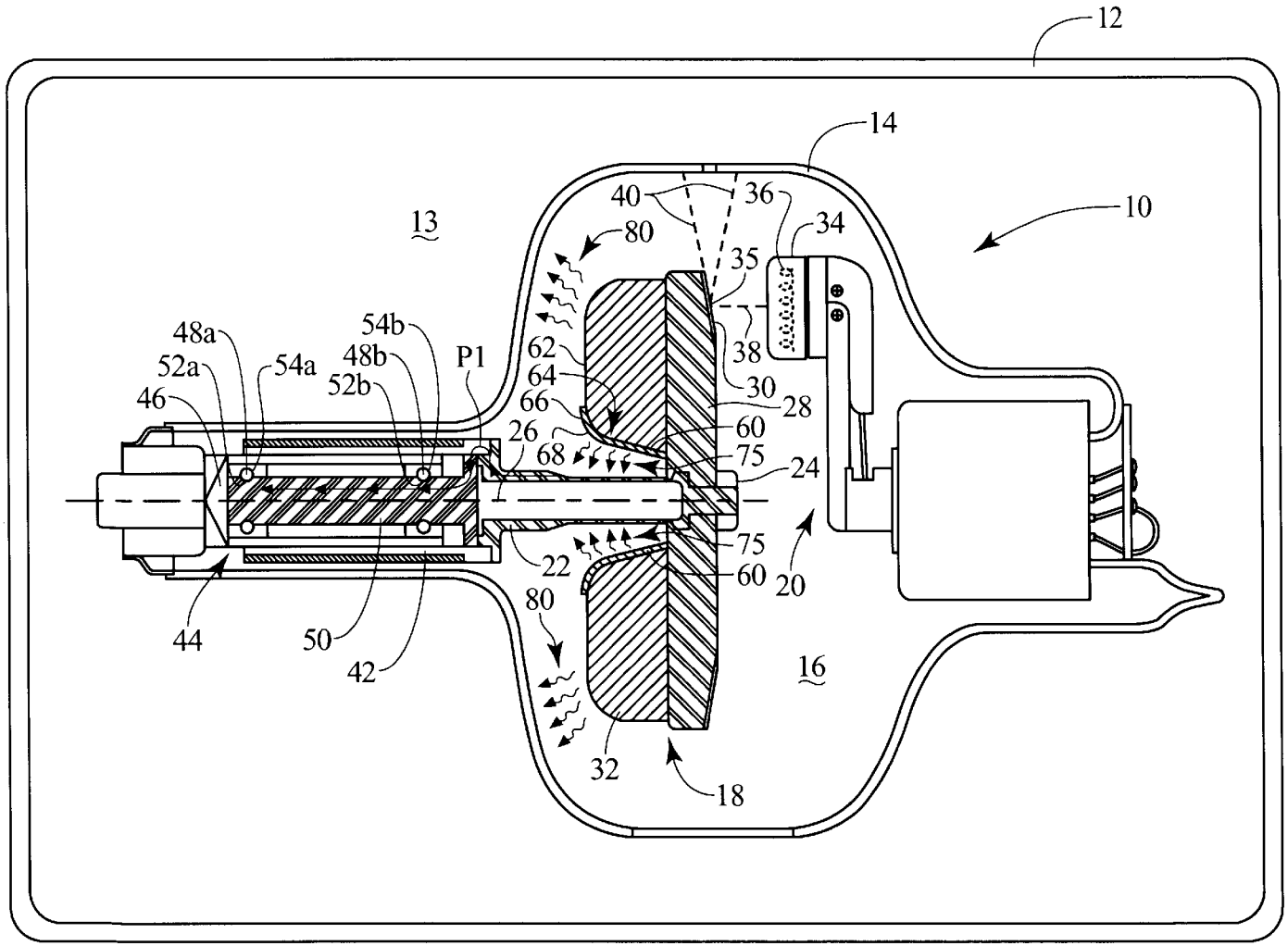
FIG. 1 is a partial cross sectional view of an x-ray tube in accordance with the present invention.

The present invention will now be described with reference to the drawings in which like reference numerals are used to refer to like elements throughout.

Turning now to FIG. 1, an x-ray tube 10 is mounted within an x-ray tube housing 12 filled with oil 13 or other suitable cooling fluid. The oil 13 is pumped through the x-ray tube housing 12 to absorb heat from the x-ray tube 10 and transfer such heat to a heat exchanger (not shown) disposed outside the x-ray tube housing 12. The x-ray tube 10 includes an envelope 14 defining an evacuated chamber or vacuum 16. In the preferred embodiment, the envelope 14 is made of glass although other suitable material including other ceramics or metals could also be used. Disposed within the envelope 14 is an anode assembly 18 and a cathode assembly 20. The anode assembly 18 includes a circular target substrate 28 having a focal track 30 along a peripheral edge of the target 28. The focal track 30 is comprised of a tungsten alloy or other suitable material capable of producing x-rays. The anode assembly 18 further includes a back plate 32 made of graphite to aid in cooling the target 28 as is known in the art. The cathode assembly 20 is stationary in nature and includes a cathode focusing cup 34 positioned in a spaced relationship with respect to the focal track 30 for focusing electrons to a focal spot 35 on the focal track 30. A cathode filament 36 (shown in phantom) mounted to the cathode focusing cup 34 is energized to emit electrons 38 which are accelerated to the focal spot 35 to produce x-rays 40.

The anode assembly 18 is mounted to a rotor stem 22 using securing nut 24 and is rotated about an axis of rotation 26 during operation. The rotor stem 22 is connected to a rotor body 42 which is rotated about the axis 26 by an electrical stator (not shown). The rotor body 42 houses a bearing assembly 44 which provides support thereto. The bearing assembly 44 includes a bearing housing 46, ball bearings 48*a*, 48*b*, and a bearing shaft 50. The bearing shaft 50 is coupled to the rotor body 42 and rotatably supports the anode assembly 18. The bearing shaft 50 also defines a pair of inner races 52*a*, 52*b*, which provide for inner race rotation of the bearings 48*a*, 48*b*, respectively. Corresponding outer races 54*a*, 54*b* are defined in the stationary bearing housing 46. Each bearing 48*a*, 48*b*, is comprised of multiple metal balls which surround the bearing shaft 50. In the present embodiment, the metal balls are made of high speed steel, each coated with a lead or silver lubricant to provide for reduced frictional contact.

Continuing to refer to FIG. 1, the present invention provides a heat shield 60 coupled to the anode assembly 18. In the present embodiment, the heat shield 60 is made of zirconium, however, other materials having a low emissivity and capable of withstanding high temperatures could alternatively be used. Other materials suitable for the heat shield 60 may, for example, include molybdenum, tantalum or niobium. The shape of the heat shield 60 contours to the shape of surface 62 of the back plate 32 along an entire length of the heat shield 60. Thus, the overall shape of the heat shield 60 of the present embodiment is similar to that of a lower portion of a bell given that the heat shield 60 includes a flared end 66 shaped to fit bend 68 along the surface 62 of the back plate 32. The thickness of the heat shield is preferably between 0.015 and 0.060 inches. It will be appreciated, however, that other suitable shapes and sizes for the heat shield 60 could alternatively be used as is discussed in more detail below.

In order to secure the heat shield 60 to the anode assembly 18, the heat shield 60 is brazed to either the back plate 32, target 28 or both using brazing techniques known in the art. It will be appreciated, however, that diffusion bonding and other suitable means for securing the heat shield 60 to the back plate 32 and/or target 28 could alternatively be used.

In operation, the heat shield 60 of the present invention serves to reduce the amount of heat radiated from the back plate 32 of the anode assembly 18 to the bearings assembly 44 and specifically to the bearings 52*a*, 52*b*. As discussed above, heat is produced by virtue of the electron beam 38 impinging on the focal spot 35 of the anode assembly 18 during the production of x-rays. A large portion of such heat is then conducted to the back plate 32 from which it radiates in order to cool the anode assembly 18. By providing heat shield 60 along an inner region 64 of the back plate 32, the amount of heat 75 thermally radiated from the from the back plate 32 of the anode assembly 18 in a region where such radiated heat would be transferred to the bearing assembly 44 is minimized. Unlike conventional heat shields which are threaded to the rotor stem 22 and simply serve to prevent a portion of the heat already thermally radiated from the anode assembly 18 from reaching the bearing assembly 44, the heat shield 60 in the present embodiment shields the bearing assembly 18 from such heat by way of actually reducing the amount of heat radiated from the anode assembly 18 in such a direction. Of course, as discussed below, the heat shield 60 is positioned so as to not significantly reduce the amount of heat radiating from the anode assembly in a direction towards the envelope 14 for cooling purposes.

More specifically, the amount of heat dissipated by a given body may be calculated by way of the radiation cooling law:

$$P=\sigma A\epsilon(T^4-T_0^4)$$

wherein "P" is the amount of heat power radiated from the body, "σ" is Boltzmann's constant, "A" is the cross sectional area of the body, "ϵ" is a unit less value between zero and one representing the emissivity of the body, "T" is the temperature of the body and "$T_0$" is the ambient temperature of the region surrounding the body. As can be seen from this equation, the amount of heat dissipated from a body is directly proportional to the emissivity of the body. Therefore, in order to reduce the amount of heat thermally radiated from the back plate 32 in a region where such heat would be substantially transferred to the bearings 52*a*, 52*b*, the heat shield 60 in the preferred embodiment has an emissivity of 0.3 or below. By comparison the back plate 32 which is comprised of graphite in the preferred embodiment has an emissivity above 0.75. By providing a heat shield 60 with such a low emissivity, the amount of heat which would otherwise radiate from the surface 62 of the back plate 32 to the bearings 52*a*, 52*b* is substantially reduced. Further, because the heat shield 60 is brazed to the back plate 32 and/or target 28, a simple joining method is used which avoids difficulties associated with threading and screwing such a heat shield in place. For instance, issues related to particles loosening from the heat shield 60 and falling into the x-ray tube 10 during operation is minimized. It will be to appreciated that the introduction of the heat shield 60 may also minimally increase the temperature of the back plate 32, however such minimum increase in temperature does not significantly affect the cooling of the anode assembly 18.

The placement and size of the heat shield 60 also contributes to the effectiveness of the heat shield 60 for a given x-ray tube configuration. More specifically, in order to ensure maximum benefit of the heat shield 60, placement of the heat shield 60 is preferably such that it blocks radiating heat which would otherwise be absorbed along the path P1 and be conducted to the bearings 52*a*, 52*b*. In the present embodiment, placement of the heat shield 60 is therefore along an inner region 64 of the back plate 32 closest to the axis 26 as this is the region in which the greatest concentration of heat would otherwise radiate from the back plate 32 towards the path P1. The size of the heat shield 60 is selected such that a balance is achieved between the ability of the heat shield 60 to reduce heat from radiating towards the path P1 and allowing heat to radiate from the back plate 32 for cooling purposes. More specifically, as is known in the art, cooling of the anode assembly 18 is partially achieved by virtue of heat radiating from the back plate 32 of the anode assembly 18 to the envelope 14 where such heat is then transferred to and absorbed by oil 13 or other cooling fluid flowing within the x-ray tube housing 12. In the present embodiment, the heat shield 60 is therefore sized to end near bend 68 along the surface 62 of the back plate 32. In this manner, radiated heat, as depicted by arrows 80, which radiates from the surface 62 of the back plate 32 substantially towards the envelope 14 is able to be removed from the anode assembly 18. It will be appreciated, however, that the size of the heat shield 66 may be varied to accommodate the needs of a given x-ray tube configuration.

Figure 2:
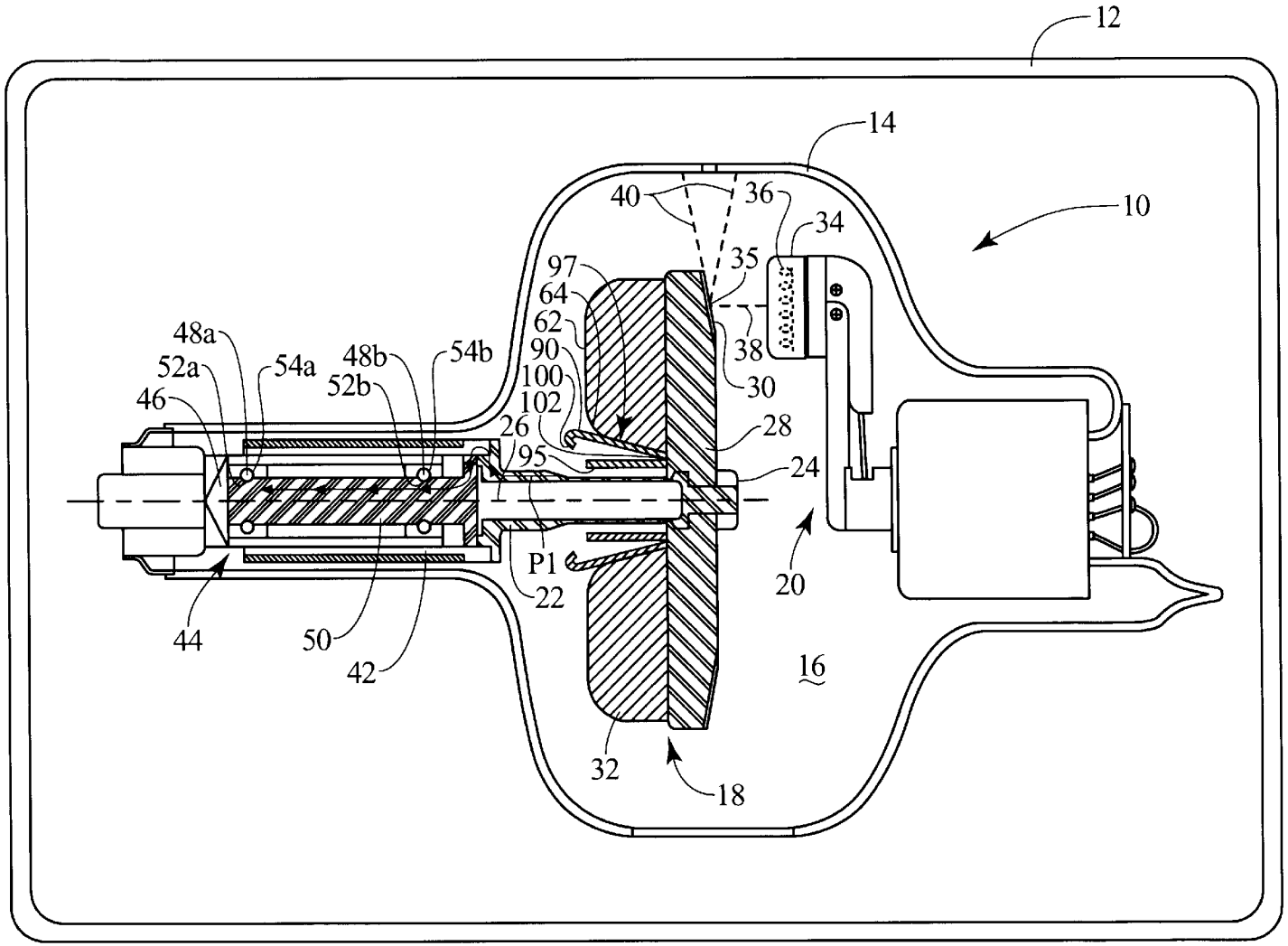
FIG. 2 is a partial cross sectional view of an x-ray tube in accordance with another embodiment of the present invention.

Referring now to FIG. 2, an alternative embodiment of the present invention is shown wherein the x-ray tube 14 includes a pair of heat shields shown as heat shield 90 and heat shield 95. Each heat shield 90, 95 is made of low emissivity material such as those materials described above with respect to heat shield 60, and serve to reduce the amount of heat passed from the surface 62 of the back plate 32 to the bearing assembly 44. More specifically, the heat shield 90 serves primarily to reduce the amount of heat radiated by the back plate 32 while the heat shield 95 serves to shield or otherwise insulate the bearing housing 44 from heat radiated in its direction. The heat shield 90 is shaped in the form of a tapered cylinder and is brazed or otherwise bonded to the surface 62 of the back plate 32 and/or target 28. An end 100 of the heat shield 90 extends away from the back plate 32 and is shown to have an inward hook. The heat shield 95 is positioned in closer proximity to the axis 26 and is shaped in the form of a cylinder having a smaller diameter than heat shield 90. An end of the heat shield 95 is brazed to a back side 102 of the target 28 so as to secure the heat shield 95 in place.

In operation, the combination of heat shield 90 and heat shield 95 provides for a dual layer of protection for preventing heat from the anode assembly 18 from reaching the bearings 52*a*, 52*b*. By providing two layers of heat shields, heat which passes through the heat shield 90 often must also pass through shield 95 in order to reach the thermally conductive path P1 to the bearings 52*a*, 52*b*. Given the low emissivity of each heat shield 90, 95, however, a substantial portion of such heat will be prevented from reaching the bearings 52*a*, 52*b*.

In the present embodiment, the shape of the heat shield 90 does not follow the contour of the surface 62 of the back plate 32 around the bend 66. Thus, in this embodiment protection of the bearings 52*a*, 52*b* is achieved by virtue of the heat shield 90 substantially remaining in a path through which heat radiated from the back plate 32 of the anode assembly 18 needs to pass to be absorbed along the path P1. Depending on the particular x-ray tube configuration at hand, the length by which the heat shield 90 overshoots the back plate 32 may be varied to achieve desired blocking characteristics. The inwardly curved hook at the end 100 of the heat shield 90 serves to reduce the electric field potential at this location so as to reduce the possibility of arcing. It will be appreciated, however, that the end 100 of the heat shield 90 could be hooked in an opposite direction than that shown, or may be bent to a desired angle to better protect the bearings 52*a*, 52*b* from heat radiated from the back plate 32. It will also be appreciated, that three or more heat shields could be concentrically attached to the anode assembly 18 and placed within the x-ray tube to provide added protection from radiated heat. Each of such heat shields may be sized to a desired length and may be tapered and/or include hooked or flared ends. Further, each of such heat shields may also be used independent of one another.

Figure 3:
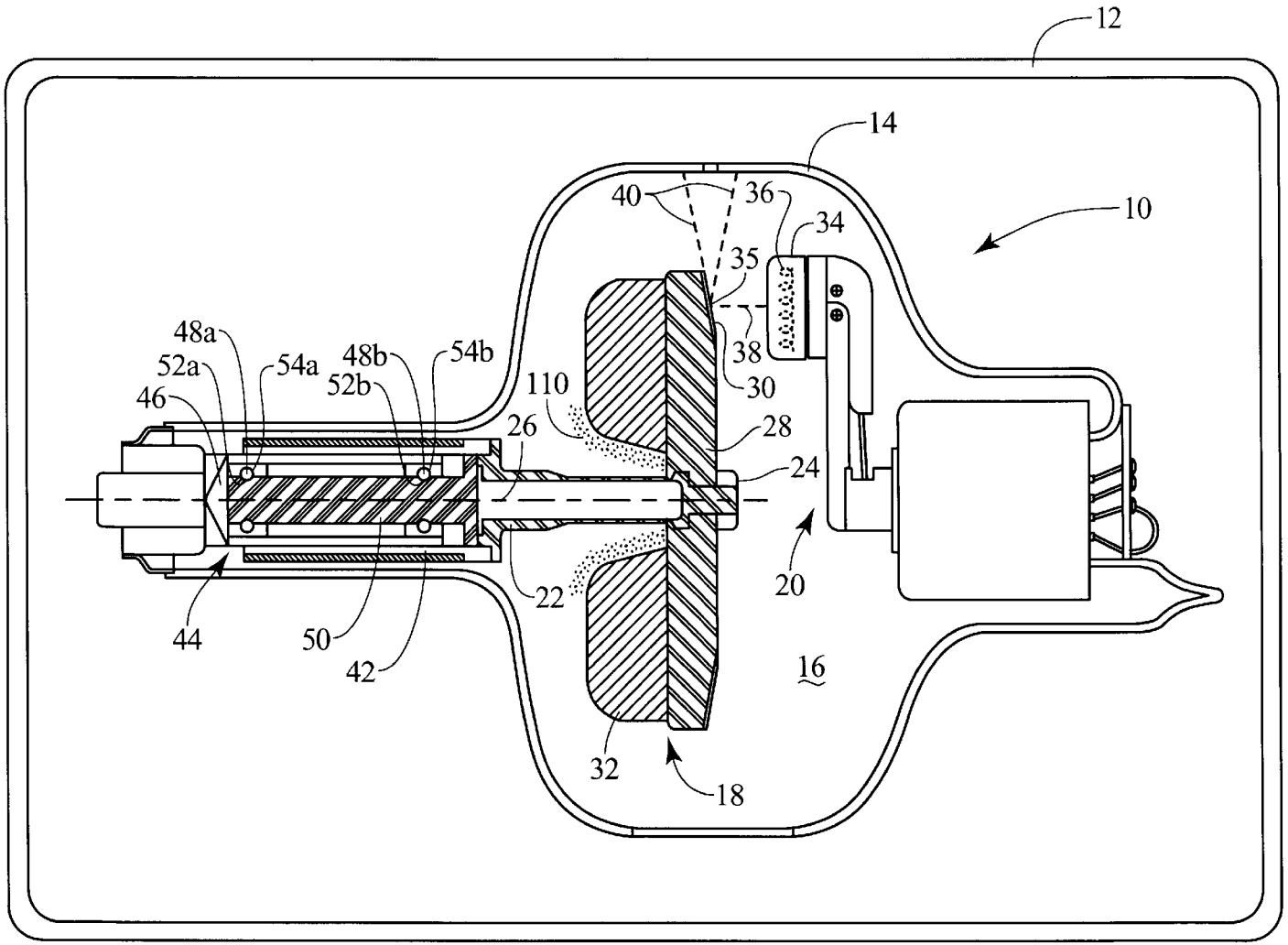
FIG. 3 is a partial cross sectional view of an x-ray tube in accordance with yet another embodiment of the present invention.

Referring now to FIG. 3, yet another embodiment of the present invention is shown. In this embodiment, rather than brazing or otherwise attaching one or more heat shields to the anode assembly 18, a portion of the surface 62 of the back plate 32 has a coating 110 comprised of a low emissivity material. The coating 110 could be applied by several means such as plasma spraying, sputtering, or allowing braze material to diffuse into the graphite of the back plate 32, for example. In the present embodiment, the coating 110 is made of zirconium, however, other suitable materials having low emissivity properties such as tungsten, tantalum, or titanium could also be used. The region in which the coating 110 is applied to the back plate 32 is substantially the same as the junction (see FIG. 1) along which heat shield 60 parallels the back plate 32. Thus, the coating 110 serves to reduce the amount of heat radiated from the back plate 32 which would otherwise reach the bearings 52*a*, 52*b*. As the coating 110 itself adheres to the back plate 32, there is no need for utilizing brazing or other bonding techniques as discussed above with respect to the heat shields. It will be appreciated, however, that the coating 110 may be used in combination with other heat shields, such as heat shield 95 (FIG. 2) in order to better protect the bearings 52*a*, 52*b*.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or their equivalence thereof.

What is claimed is:

1. An x-ray tube comprising:

a cathode assembly, said cathode assembly including a filament which emits electrons when heated;

an anode assembly defining a target for intercepting the electrons such that collision between the electrons and the anode assembly generate x-rays from an anode focal spot;

a bearing assembly rotatably supporting the anode assembly;

an envelope enclosing the anode assembly, the cathode assembly, and the bearing assembly in a vacuum; and means for reducing heat radiating from a region of the anode assembly, the heat radiating reducing means in contiguous contact with the region of the anode assembly.

2. The x-ray tube of claim 1, wherein the region is proximate the bearing assembly.

3. The x-ray tube of claim 1, wherein said means comprises a shield coupled to the anode assembly.

4. The x-ray tube of claim 3, wherein the anode assembly includes a target and a back plate coupled to the target.

5. The x-ray tube of claim 4, wherein the shield is brazed to at least one of the back plate and the target.

6. The x-ray tube of claim 4, wherein the shield is shaped such that it contours to the back plate.

7. The x-ray tube of claim 3, wherein an end of the shield extends beyond the anode assembly.

8. The x-ray tube of claim 7, wherein the end of the shield is hooked shaped.

9. The x-ray tube of claim 7, wherein the end of the shield is flared.

10. The x-ray tube of claim 3, wherein the shield has an emissivity of substantially 0.3 or below.

11. The x-ray tube of claim 10, wherein the shield comprises one of zirconium, molybdenum, and tantalum.

12. An x-ray tube comprising:

a cathode assembly, said cathode assembly including a filament which emits electrons when heated;

an anode assembly defining a target for intercepting the electrons such that collision between the electrons and the anode assembly generate x-rays from an anode focal spot;

a bearing assembly rotatable supporting the anode assembly;

an envelope enclosing the anode assembly, the cathode assembly, and the bearing assembly in a vacuum; and means for reducing heat radiating from a region of the anode assembly, the heat radiating reducing means in contiguous contact with the region of the anode assembly, wherein said means is a coating applied to the anode assembly.

13. The x-ray tube of claim 12, wherein the anode assembly includes a back plate and the coating is applied to the back plate.

14. The x-ray tube of claim 12, wherein the coating has an emissivity of substantially 0.3 or below.

15. An x-ray tube comprising:

an envelope defining an evacuated chamber in which an anode assembly is rotatably supported in a bearing assembly; and a shield coupled in contiguous contact with a portion of the anode assembly for reducing heat radiated to the stem from the production of x-rays.

16. The x-ray tube of claim 15, wherein the anode assembly includes a target and a back plate attached to the target, and wherein the shield is coupled to the back plate.

17. The x-ray tube of claim 16, wherein the shield is shaped such that it contours to the back plate.

18. The x-ray tube of claim 15, wherein the anode assembly includes a target and the shield is coupled to the target.

19. The x-ray tube of claim 18, wherein the shield is brazed to the target.

20. The x-ray tube of claim 19, wherein the anode assembly further includes a back plate and a portion of the back plate is coated with a coating having an emissivity of substantially 0.3 or below.

21. In an x-ray tube including an envelope defining an evacuated chamber, an anode assembly rotatably mounted within the evacuated chamber by way of a bearing assembly and operatively coupled to a rotor to provide rotation thereof, and a cathode assembly for generating a beam of electrons which impinge upon the rotating anode assembly on a focal spot to generate a beam of x-rays, the x-ray tube comprising:

a first region for emitting heat from the anode assembly;

a second region on a surface of the anode assembly facing the bearing assembly, the second region having a lower emissivity than the first region, whereby heat radiating from the second region is reduced thereby reducing heat transference to the bearing assembly.

22. The x-ray tube of claim 21, wherein said second region has an emissivity of substantially 0.3 or below and is comprised of one of zirconium and titanium.

23. The x-ray tube of claim 22, wherein the second region further comprises a heat shield coupled to the anode assembly.

24. The x-ray tube of claim 23, wherein the anode assembly includes a target and the heat shield is coupled to the target.

25. The x-ray tube of claim 24, wherein the heat shield is brazed to the target.

26. A method of reducing heat transference from an anode assembly to a bearing assembly rotatably mounting the anode assembly within an evacuated chamber defined by an x-ray tube envelope, the method comprising the step of:

applying a low emissivity coating to a surface of the anode assembly.

27. The method of claim 26, wherein the coating has an emissivity of substantially 0.3 or below.

28. The method of claim 27, wherein the coating is comprises one of zirconium and titanium.

29. The method of claim 26, wherein the coating is applied to a surface of the anode assembly in proximity to the bearing assembly.

30. The method of claim 29, wherein the coating has an emissivity of substantially 0.3 or below.

31. The x-ray tube of claim 21 wherein the second region is a heat shield in contiguous physical contact with a portion of the first region.

32. The x-ray tube of claim 31 including a stem for supporting the anode assembly in the bearing assembly, wherein the second region is proximate the stem.

33. In an x-ray tube including an envelope defining an evacuated chamber, an anode assembly rotatably mounted within the evacuated chamber by way of a bearing assembly and operatively coupled to a rotor to provide rotation thereof, and a cathode assembly for generating a beam of electrons which impinge upon the rotating anode assembly on a focal spot to generate a beam of x-rays, the x-ray tube comprising:

a first region for emitting heat from the anode assembly;

a second region on a surface of the anode assembly facing the bearing assembly, the second region having a lower emissivity than the first region, whereby heat radiating from the second region is reduced thereby reducing heat transference to the bearing assembly, wherein the second region is a heat shield coating in contiguous physical contact with a portion of the first region.

34. An x-ray tube anode comprising:

a target including a substrate having a focal track for generating x-rays and a rear portion from which heat is radiated; and a heat shield integral to the rear portion of the target.

35. The x-ray tube anode of claim 34 wherein the rear portion is a back plate mounted to the substrate.

36. The x-ray tube anode of claim 34 wherein the heat shield integral to the rear portion has a lower emissivity than the rest of the back plate.

* * * * *